US008125230B2

(12) United States Patent
Bharadwaj et al.

(10) Patent No.: US 8,125,230 B2
(45) Date of Patent: Feb. 28, 2012

(54) MOTOR CURRENT BASED AIR CIRCUIT OBSTRUCTION DETECTION

(75) Inventors: Raj Mohan Bharadwaj, Maple Grove, MN (US); David Lazarovich, Thornhill, CA (US)

(73) Assignee: Honeywell International Inc., Morristown, NJ (US)

( * ) Notice: Subject to any disclaimer, the term of this patent is extended or adjusted under 35 U.S.C. 154(b) by 465 days.

(21) Appl. No.: 12/336,910

(22) Filed: Dec. 17, 2008

(65) Prior Publication Data

US 2010/0148748 A1 Jun. 17, 2010

(51) Int. Cl.
*G01R 31/28* (2006.01)

(52) U.S. Cl. ..... 324/522

(58) Field of Classification Search ..... None
See application file for complete search history.

(56) References Cited

U.S. PATENT DOCUMENTS 6,776,817 B2 * 8/2004 Lentz et al. ..... 73/204.26
(Continued)

FOREIGN PATENT DOCUMENTS

JP 05332590 A 12/1993
(Continued)

OTHER PUBLICATIONS

European Patent Office "European Search Report" mailed Apr. 16, 2010 for Application No. 09177807.6-2301 filed Dec. 2, 2009.

*Primary Examiner* — Jermele M Hollington
(74) *Attorney, Agent, or Firm* — Ingrassia Fisher & Lorenz, P.C.

(57) ABSTRACT

A method for determining an obstruction in an air circuit, the air circuit having a fan and a motor that drives the fan, includes the steps of obtaining a load current of a motor coupled to the air circuit, comparing the load current to a predetermined value, and determining the obstruction using the load current and the predetermined value.

20 Claims, 5 Drawing Sheets

U.S. PATENT DOCUMENTS

| | | | | |
|---|---|---|---|---|
| 6,822,216 | B2 * | 11/2004 | Lang et al. | 340/556 |
| 2003/0097875 | A1 * | 5/2003 | Lentz et al. | 73/204.26 |
| 2005/0154495 | A1 * | 7/2005 | Shah | 700/276 |
| 2005/0247194 | A1 | 11/2005 | Kang et al. | |
| 2006/0055547 | A1 | 3/2006 | DiMaggio | |
| 2006/0058924 | A1 * | 3/2006 | Shah | 700/276 |
| 2007/0013534 | A1 * | 1/2007 | DiMaggio | 340/607 |
| 2007/0146148 | A1 | 6/2007 | Kawasaki et al. | |

FOREIGN PATENT DOCUMENTS

| | | | |
|---|---|---|---|
| JP | 10309422 | A | 11/1998 |
| JP | 2008136911 | A | 6/2008 |
| WO | 2005059669 | A1 | 6/2005 |
| WO | 2006045889 | A1 | 5/2006 |

* cited by examiner

MOTOR CURRENT BASED AIR CIRCUIT OBSTRUCTION DETECTION

TECHNICAL FIELD

The present invention generally relates to environmental control air circuits and, more particularly, to systems and methods for estimating obstruction in air circuits using motor current.

BACKGROUND

Determining the state of health circuits in environmental control systems, such as in forced air cooling circuits used in aircraft, can be difficult. For example, the air circuit can be affected by blocking or ruptures. In the case of blockage, the air flow may diminish gradually or instantly. In the case of ruptures, the effect is similar, with diminished air flow. In either case, it is often difficult to estimate such obstructions of the air cooling circuit, for example because such obstructions can occur at one of many places along the air circuit and because access to such air circuits is often limited.

Accordingly, it is desirable to provide systems that provide for improved estimation of obstructions in air circuits. It is also desirable to provide program products and methods for such improved that provide for improved estimation of obstructions in air circuits. Furthermore, other desirable features and characteristics of the present invention will be apparent from the subsequent detailed description and the appended claims, taken in conjunction with the accompanying drawings and the foregoing technical field and background.

BRIEF SUMMARY

In accordance with one exemplary embodiment of the present invention, a method for determining an obstruction in an air circuit, the air circuit comprising a fan and a motor that drives the fan, is provided. The method comprises the steps of obtaining a load current of a motor coupled to the air circuit, comparing the load current to a predetermined value, and determining the obstruction using the load current and the predetermined value.

In another exemplary embodiment of the present invention, a program product for determining an obstruction in an air circuit, the air circuit comprising a fan and a motor that drives the fan, is provided. The program product comprises a program and a computer readable signal bearing medium. The program is configured to at least facilitate obtaining a load current of a motor coupled to the air circuit, comparing the load current to a predetermined value, and determining the obstruction using the load current and the predetermined value. The computer readable signal bearing medium bears the program.

In a further exemplary embodiment of the present invention, a system for determining an obstruction in an air circuit, the air circuit comprising a fan and a motor that drives the fan, is provided. The system comprises a sensor and a processor. The sensor is configured to at least facilitate obtaining a load current of a motor coupled to the air circuit. The processor is configured to at least facilitate comparing the load current to a predetermined value and determining the obstruction using the load current and the predetermined value.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Figure 1:
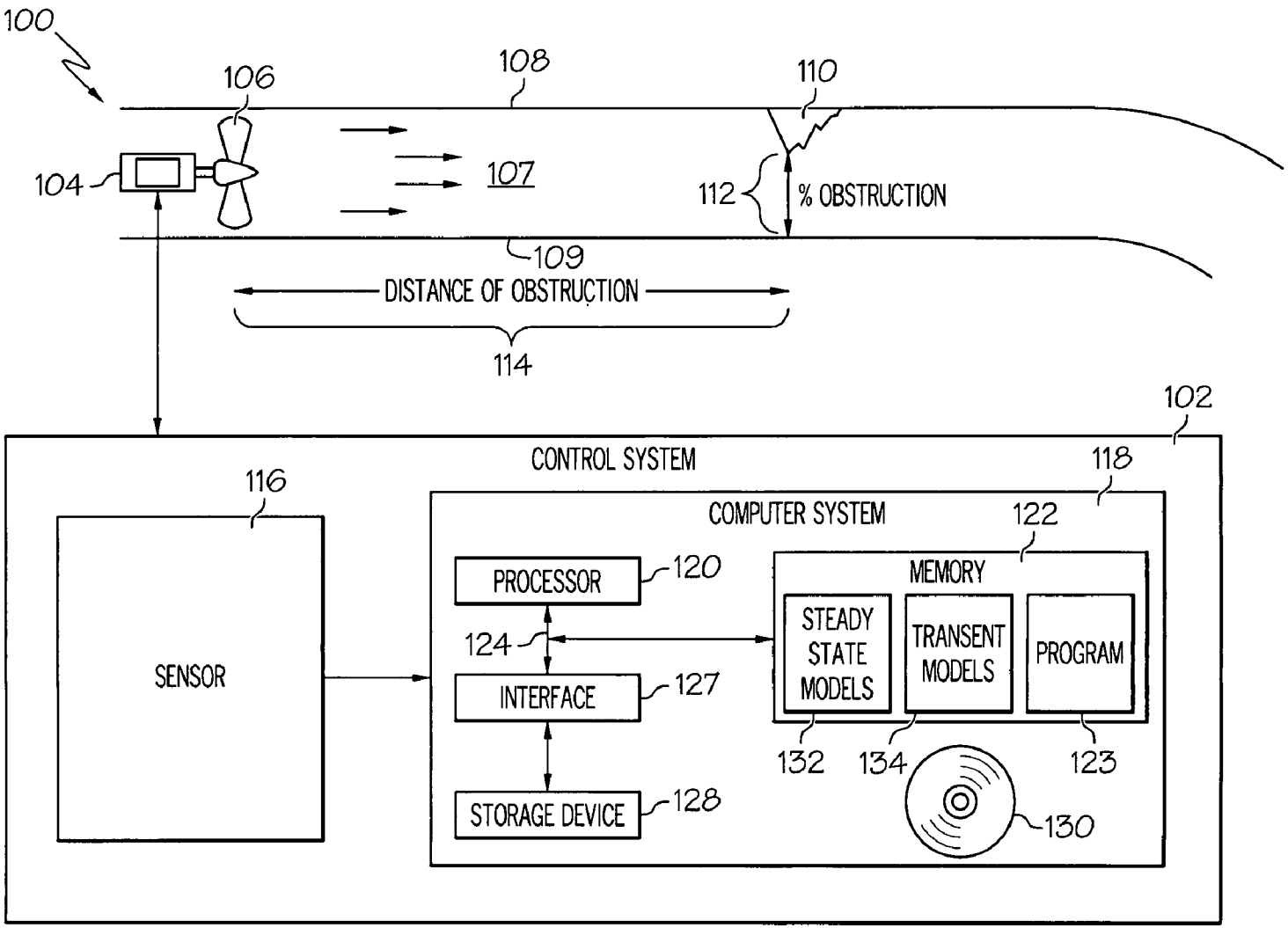
FIG. 1 is a functional block diagram of an exemplary air circuit for an environmental control system, for example for an environmental control system of an aircraft, along with a control system for use in connection therewith, in accordance with an exemplary embodiment of the present invention, and that can be implemented as part of an aircraft depicted in functional block diagram form in FIG. 5 in accordance with an exemplary embodiment.

FIG. 1 is a functional block diagram of an exemplary air circuit 100 for an environmental control system, for example for an environmental control system of an aircraft, along with a control system 102 for use in connection therewith, in accordance with an exemplary embodiment of the present invention. As depicted in FIG. 1, the air circuit 100 includes a motor 104, a fan 106, and a plurality of walls 108, 109 that define a fluid flow passageway 107 therebetween. The motor 104 provides current to the fan 106, to thereby driver and operate the fan 106. The fan 106, in turn, propels fluid, such as cooling air, at a flow rate through the fluid flow passageway 107. The fluid is then used in cooling a desired aircraft, vehicle, and/or other device and/or portions thereof.

In a preferred embodiment, the air circuit 100 is used as part of an environmental control system for an aircraft. In other embodiments, the air circuit 100 is used as part of an air conditioning unit and/or other climate control device for an automobile, a locomotive, a space craft, a marine vehicle, and/or any one of a number of different types of vehicles. In yet other embodiments, the air circuit 100 is used as part of an air conditioning unit and/or other climate control device for a house, an apartment complex, an office building, and/or any one of a number of other different types of buildings, machines, systems, and/or other types of devices.

As shown in FIG. 1, the air circuit 100 has an obstruction 110 within the fluid flow passageway 107. In certain embodiments, the obstruction 110 may comprise a rupture and/or other deformation of one or more of the plurality of walls 108, 109. In other embodiments, the obstruction 110 may comprise dirt and/or other debris formed and/or stuck along one or more of the plurality of walls 108, 109 and/or otherwise within the fluid flow passageway 107. Typically, either type of such obstruction 110, and/or another type of obstruction 110, can decrease the velocity of and/or otherwise interfere with the flow of fluid through the fluid flow passageway 107, which can thereby decrease the cooling power and/or efficiency of, and/or increase the cooling time for, the air circuit 100 and of any cooling units associated with therewith.

Figure 5:
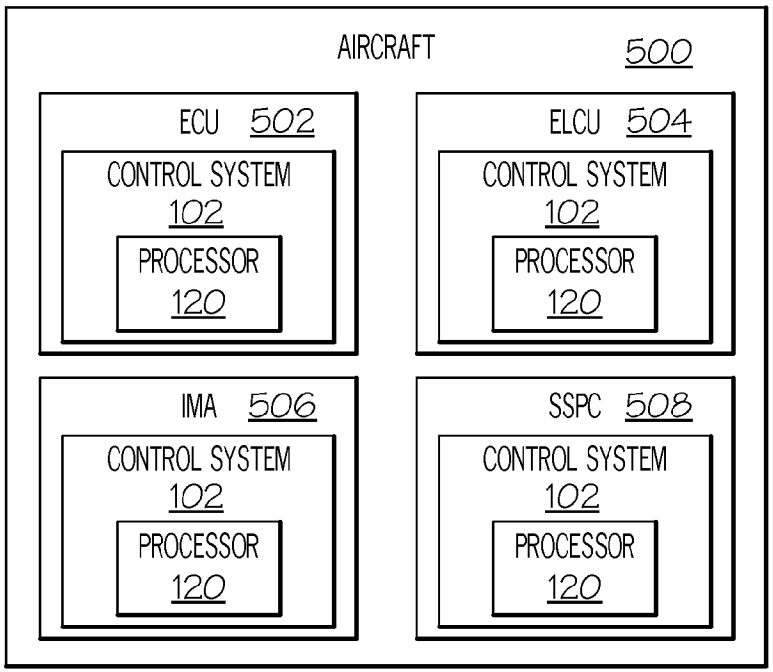
FIG. 5 is a functional block diagram of an aircraft in which the environmental control system of FIG. 1 can be implemented, in accordance with an exemplary embodiment.

The control system 102 is coupled to the motor 104 of the air circuit 100. In one preferred embodiment, the control system 102 is part of an environmental control system of an aircraft, such as environmental control unit (ECU) 502 of aircraft 500 of FIG. 5. In another preferred embodiment, the control system 102 is part of a load protection and control unit (ELCU) of an aircraft, such as ELCU 504 of aircraft 500 of FIG. 5. In another preferred embodiment, the control system 102 is part of an integrated modular avionic unit (IMA) of an aircraft, such as IMA 506 of aircraft 500 of FIG. 5. In yet another preferred embodiment, the control system 102 is part of a solid state power controller (SSPC) of an aircraft, such as SSPC 508 of aircraft 500 of FIG. 5. In various other embodiments, the control system 102 may be part of and/or coupled to any number of different types of vehicles, vehicle systems, buildings, building systems, and/or any number of other different types of machines, systems, and/or devices.

The control system 102 determines a measure of motor load current from the motor 104, and utilizes this measure in estimating a measure of the obstruction 110 of the fluid flow passageway. In a preferred embodiment, the control system 102 compares the measure of motor load current with prior measures from other models that are generated using prior testing, selects one or more such appropriate models as being most relevant to the current operation of the motor 104, and estimates a percentage obstruction 112 of the fluid flow passageway 107 and/or a distance 114 between the obstruction 110 and the fan 106 using the measure of motor load current and the selected models. Also in a preferred embodiment, the control system 102, in so doing, implements the steps of the process 200 as set forth in FIGS. 2-4 and described further below in accordance with an exemplary embodiment of the present invention.

As depicted in FIG. 1, the control system 102 includes a sensor 116 and a computer system 118. The sensor 116 is preferably coupled to the motor 104, and receives values of the motor load current from the motor 104 and provides these values of the motor load current to the processor 120 of the computer system 118 for processing. The sensor 116 preferably includes a motor load current sensor that is coupled between the motor 104 and the processor 120. It will be appreciated that multiple sensors 116 may be used, and/or that the types of the one or more sensors 116 may vary in different embodiment. In addition, while the sensor 116 is depicted separate from the computer system 118, it will be appreciated that the sensor 116 may be a part of the computer system 118 in certain embodiments, among other possible variations to the sensor 116, the control system 102, and/or the air circuit 100 of FIG. 1.

The computer system 118 includes a processor 120, an interface 127, a memory 122, a storage device 128, and a bus 124. The processor 120 is preferably coupled to the sensor 116. The processor 120 performs the computation and control functions of the control system 102, and may comprise any type of processor 120 or multiple processors 120, single integrated circuits such as a microprocessor, or any suitable number of integrated circuit devices and/or circuit boards working in cooperation to accomplish the functions of a processing unit.

Specifically, in a preferred embodiment of the present invention, the processor 120 is configured to obtain the measure of motor load current from the motor 104 via the sensor 116, compare the measure of motor load current with prior measures from other models that are generated using prior testing, select one or more such appropriate models, and estimate a percentage obstruction 112 of the fluid flow passageway 107 and/or a distance 114 between the obstruction 110 and the fan 106 using the measure of motor load current and the selected models. Also in a preferred embodiment, the processor 120, in so doing, implements the steps of the process 200 as set forth in FIGS. 2-4 and described further below in accordance with an exemplary embodiment of the present invention.

During operation, the processor 120 executes one or more vehicle programs 123 preferably stored within the memory 122 and, as such, controls the general operation of the control system 102. Such one or more vehicle programs 123 are preferably coupled with a computer-readable signal bearing media bearing the product. Such program products may reside in and/or be utilized in connection with any one or more different types of control systems 102 and/or other computer systems, which can be located in a central location or dispersed and coupled via an Internet or various other different types of networks or other communications. In certain exemplary embodiments, the processor 120 and/or program products may be used to implement a process for estimating air circuit obstruction, preferably via the process 200 depicted in FIGS. 2-4 and described further below in connection therewith, in accordance with an exemplary embodiment of the present invention. For example, in certain such exemplary embodiments, the one or more program products may be used to operate the various components of the control system 102, to connect such components, or to control or run various steps pertaining thereto in order to facilitate processes for determining air circuit obstruction.

The memory 122 stores one or more programs 123 that at least facilitates one or more processes for determining air circuit obstruction values, such as the process 200 depicted in FIGS. 2-4 and described further below in connection therewith and/or facilitating operation of the control system 102 and/or various components thereof, such as those described above. The memory 122 can be any type of suitable memory. This would include the various types of dynamic random access memory (DRAM) such as SDRAM, the various types of static RAM (SRAM), and the various types of non-volatile memory (PROM, EPROM, and flash). It should be understood that the memory 122 may be a single type of memory component, or it may be composed of many different types of memory components.

The memory 122 also preferably stores various steady state models 132 and transient state models 134 representing that are used for comparing with the motor load current obtained by sensor 116, depending on the state of the motor 104. Preferably, steady state models 132 are used if the motor 104 is in a steady state, and transient state models 134 are preferably used if the motor 104 is in a transient state, as described in greater detail further below in connection with FIGS. 2-4.

In addition, the memory 122 and the processor 120 may be distributed across several different computers that collectively comprise the control system 102. For example, a portion of the memory 122 may reside on a computer within a particular apparatus or process, and another portion may reside on a remote computer.

The computer bus 124 serves to transmit programs, data, status and other information or signals between the various components of the control system 102. The computer bus 124 can be any suitable physical or logical means of connecting computer systems and components. This includes, but is not limited to, direct hard-wired connections, fiber optics, and infrared and wireless bus technologies.

The computer interface 127 allows communication to the control system 102, for example from a system operator and/or another computer system, and can be implemented using any suitable method and apparatus. It can include one or more network interfaces to communicate to other systems or components, one or more terminal interfaces to communicate with technicians, and one or more storage interfaces to connect to storage apparatuses such as the storage device 128.

The storage device 128 can be any suitable type of storage apparatus, including direct access storage devices 128 such as hard disk drives, flash systems, floppy disk drives and optical disk drives. In one exemplary embodiment, the storage device 128 is a program product from which memory 122 can receive a program 123 that at least facilitates determining air circuit obstruction values, such as the process 200 of FIGS. 2-4 and described further below in connection therewith, and/or that facilitates operation of the control system 102 and/or components thereof. The storage device 128 can comprise a disk drive device that uses disks 130 to store data. As one exemplary implementation, the control system 102 may also utilize an Internet website, for example for providing or maintaining data or performing operations thereon.

It will be appreciated that while this exemplary embodiment of the control system 102 is described in the context of a fully functioning computer system, those skilled in the art will recognize that the mechanisms of the present invention are capable of being distributed as a program product in a variety of forms, and that the present invention applies equally regardless of the particular type of computer-readable signal bearing media used to carry out the distribution. Examples of signal bearing media include: recordable media such as floppy disks, hard drives, memory cards and optical disks, and transmission media such as digital and analog communication links.

Figure 2:
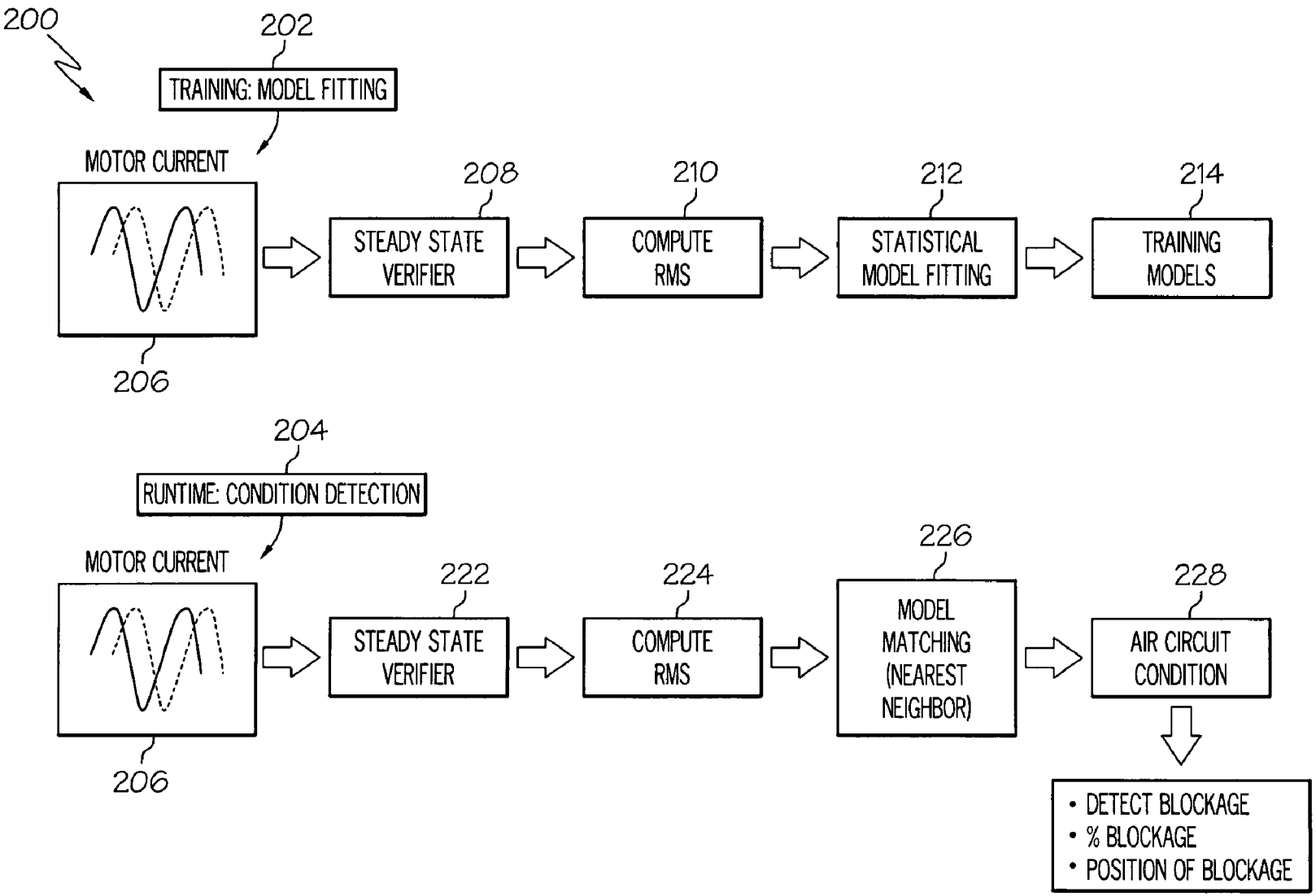
FIG. 2 is a flowchart of a process for determining an obstruction of an air circuit, such as the air circuit of FIG. 1, the process including a model fitting portion and a condition detection portion, in accordance with an exemplary embodiment of the present invention.

FIG. 2 is a flowchart of a process 200 for determining an obstruction of an air circuit, such as the air circuit 100 of FIG. 1, in accordance with an exemplary embodiment of the present invention. In one preferred embodiment, the process 200 includes a model fitting portion 202 and a condition detection portion 204, as depicted in FIG. 2. However, this may vary in other embodiments. For example, in certain embodiments, the model fitting portion 202 may already be conducted, and the process 200 thereafter comprises the condition detection portion 204.

The model fitting portion 202 utilizes motor load current values 206 in generating training models for subsequent use in determining air circuit obstruction in subsequent operations of the motor and/or one or more different motors. In the depicted embodiment, the model fitting portion 202 begins with the step of verifying the state of the motor (step 208). In a preferred embodiment, this step 208 is conducted by the processor 120 with respect to one or more different motors 104 of FIG. 1 as to whether such motors 104 are in a steady state or a transient state.

In addition, a root mean square value of motor load current is determined (step 210). In a preferred embodiment, the root mean square value of motor load current is calculated by the processor 120 of FIG. 1 using motor load current values obtained via the sensor 116 of FIG. 1 from the motor 104 of FIG. 1.

Next, statistical modeling is conducted based on the steady state verifiers and the calculated root mean square values (step 212). Specifically, statistical modeling of motor load current various one or more measures of obstruction of the air circuit (e.g., as measured by a percentage obstruction of the fluid flow passageway and/or the distance between the obstruction and the fan).

Figure 3:
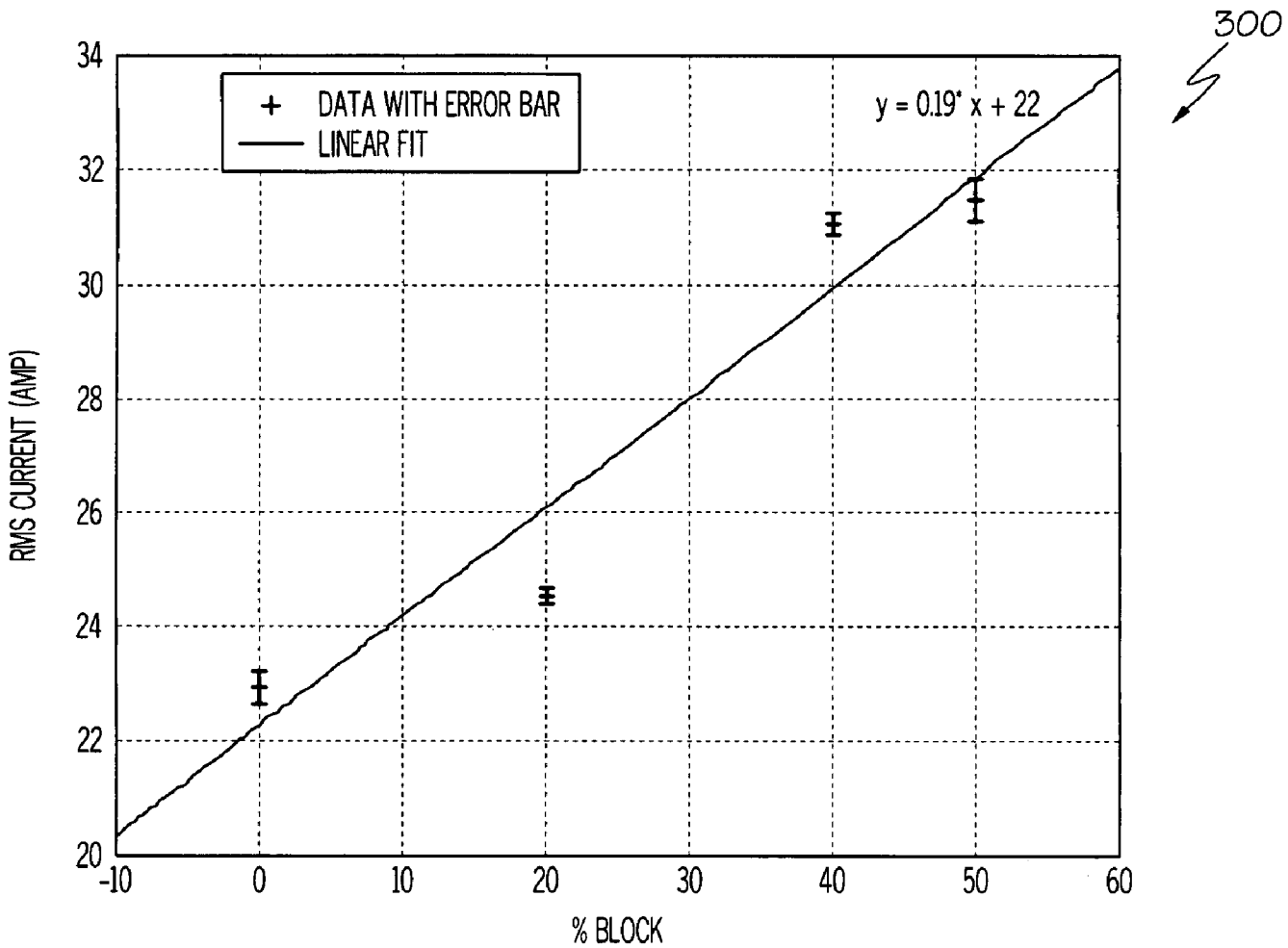
FIG. 3 is a graphical representation of a step of the model fitting portion of the process of FIG. 2, specifically, a process for statistical model fitting of data, in accordance with an exemplary embodiment of the present invention.

FIG. 3 depicts a graph illustrating one such exemplary statistical modeling in accordance with one exemplary embodiment of the present invention with respect to percent blockage of the fluid flow passageway. It will be appreciated that various other variables and/or modeling techniques may be used in various embodiments of the present invention. In a preferred embodiment, the statistical modeling is performed by the processor 120 of FIG. 1 using various different motors of various different air circuits during initial testing following the manufacture thereof. However, other data and testing may also be used, such as, by way of example only, published testing data, experimental testing data (for example, with known obstructions introduced into the air circuits for testing purpose), and/or for testing and/or maintenance data during or after subsequent operation of such motors, for example when the motors and/or air circuits associated therewith are being examined for maintenance and/or repair purposes.

Returning now to FIG. 2, in a preferred embodiment, separate training models are generated based on the steady state verifiers (step 214). Specifically, in one preferred embodiment, steady state models are generated using the motor load current data from various motors operating under steady state conditions. These steady state models represent a correlation between motor load current and air circuit obstruction under steady state conditions of the motor. Likewise, in such a preferred embodiment, transient state models are generated using the motor load current data from various motors operating under transient conditions.

Also in a preferred embodiment, the steady state models are generated by the processor 120 of FIG. 1, and are thereafter stored in the memory 122 as the steady state models 132 represented in FIG. 1. The processor 120 then retrieves these steady state models 132 from the memory 122 during execution of the condition detection portion 204 of the process 200 described below for use in comparing with recent values of motor load current for determining the obstruction 110 of the air circuit 100 of FIG. 1 when the motor 104 of FIG. 1 is operating in a steady state condition. Similarly, in one such preferred embodiment, the transient state models are also generated by the processor 120 of FIG. 1, and are thereafter stored in the memory 122 as the transient state models 134 represented in FIG. 1. The processor 120 then retrieves these transient state models 134 from the memory 122 during execution of the condition detection portion 204 of the process 200 described below for use in comparing with recent values of motor load current for determining the obstruction 110 of the air circuit 100 of FIG. 1 when the motor 104 is operating in a transient state condition.

Preferably the condition detection portion 204 is conducted with respect to a motor in operation for which an obstruction determination is desired. As depicted in FIG. 2, in a preferred embodiment, the condition detection portion 204 utilizes motor load current values 206 of such a motor for determining air circuit obstruction in an air circuit receiving fluid flow as directed by a fan operated by such motor. In the depicted embodiment, the condition detection portion 204 begins with the step of verifying the state of the motor (step 222). In a preferred embodiment, this step 222 is conducted by the processor 120 with respect to a motor 104 of FIG. 1 for which an obstruction determination is desired, and specifically as to whether such motor 104 is in a steady state or a transient state.

In addition, a root mean square value of motor load current of this motor is determined (step 224). In a preferred embodiment, the root mean square value of motor load current is calculated by the processor 120 of FIG. 1 using motor load current values obtained via the sensor 116 of FIG. 1 from the motor 104 of FIG. 1.

Next, statistical model matching is conducted based on the steady state verifiers and the calculated root mean square values (step 226). Specifically, in a preferred embodiment, the computed root mean square value of motor load current is compared with the steady state training models of step 214 if the motor is in a steady state. Conversely, in a preferred embodiment, the computer root mean square value of motor load current is compared with the transient training models of step 214 if the motor is in a transient state.

Preferably, in either case, one or more such training models are selected as most closely representing the motor load current of the motor. Also in a preferred embodiment, this step is conducted by the processor 120 of FIG. 1 using the steady state models 132 stored in the memory 122 of FIG. 1 if the motor is in a steady state condition, and, alternatively, using the transient state models 134 stored in the memory 122 of FIG. 1 if the motor is in a transient condition. In so doing, the processor 120 of FIG. 1 preferably compares the measure of motor load current with prior motor load current measures from such models and selects one or more such models accordingly.

Next, an air circuit condition is estimate (step 228) using the selected models. In certain preferred embodiments, the air circuit condition is estimated as a percentage obstruction 112 of the fluid flow passageway 107 of FIG. 1 and/or a distance 114 between the obstruction 110 and the fan 106 of FIG. 1. However, this may vary in other embodiments. For example, in one such preferred embodiment, one or more such measures of obstruction are estimated using a single selected model, for example by using a value equal to a known obstruction value of such selected model. In other preferred embodiments, one or more such measures of obstruction are estimated using multiple selected models, for example by averaging, interpolating, and/or extrapolating between the obstruction values of such multiple selected models.

Figure 4:
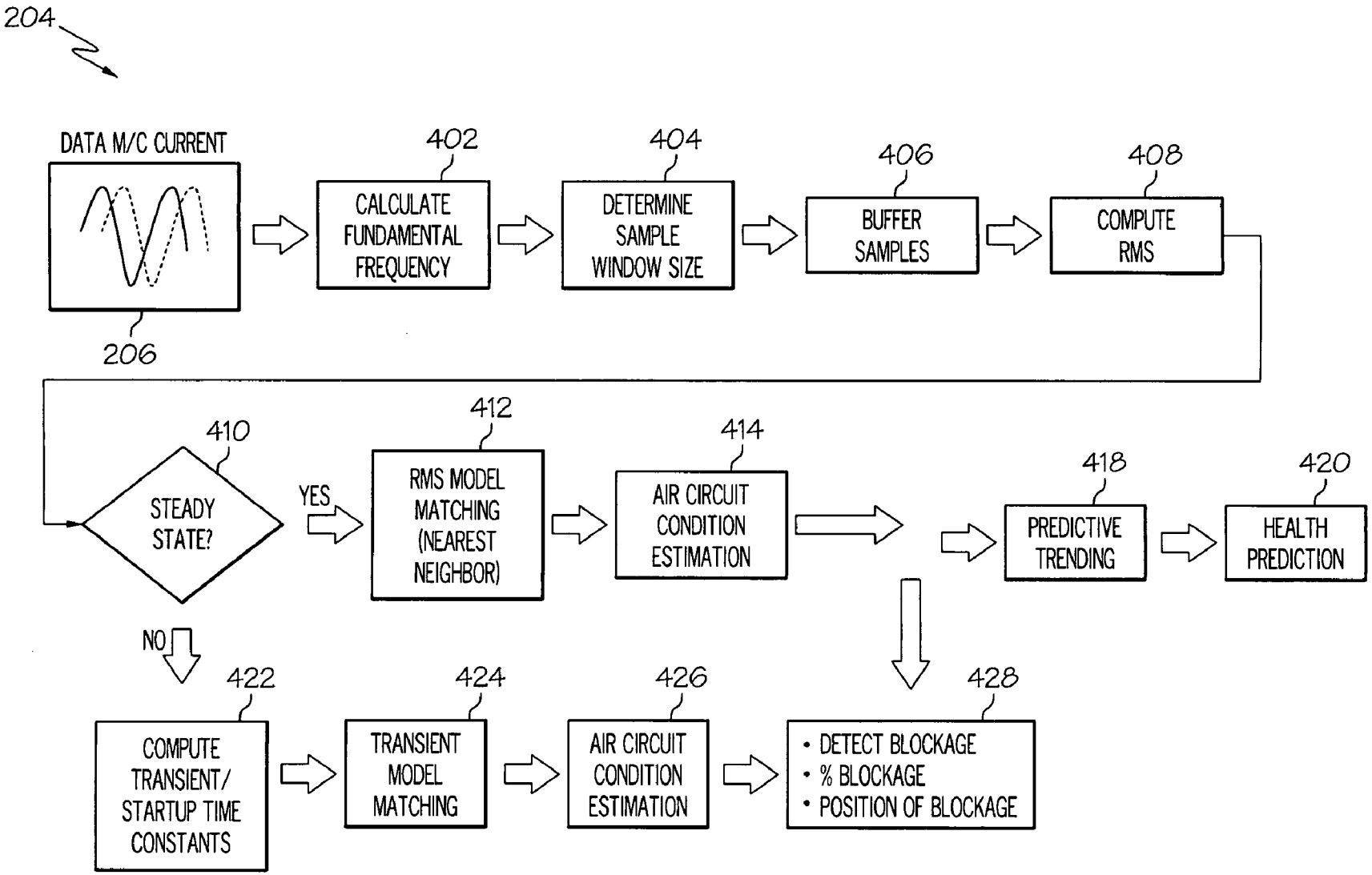
FIG. 4 is a flowchart of a more detailed implementation of the condition detection portion of the process of FIG. 2, in accordance with an exemplary embodiment of the present invention.

FIG. 4 is a flowchart of a more detailed implementation of the condition detection portion 204 of the process 200 of FIG. 2, in accordance with an exemplary embodiment of the present invention. As referenced above, in a preferred embodiment, the condition detection portion 204 utilizes motor load current values 206 of such a motor for determining air circuit obstruction in an air circuit receiving fluid flow as directed by a fan operated by such motor.

In the depicted embodiment, the condition detection portion 204 begins with the step of calculating a fundamental frequency of the motor (step 402). In a preferred embodiment, the fundamental frequency pertains to a frequency of motor load current provided by the motor 104 of FIG. 1 for which obstruction determinations are desired. Also in a preferred embodiment, the fundamental frequency is calculated by the processor 120 of FIG. 1.

A window sample size is also obtained (step 404). In a preferred embodiment, the window sample size represents an optimal number of samples for motor load current determination, and is based upon the fundamental frequency using techniques known in the art. Also in a preferred embodiment, the window sample size is determined by the processor 120 of FIG. 1 using guidelines stored in the memory 122, for example based on prior experimental test results and/or published data or literature.

Next, the buffer samples are obtained (406). In a preferred embodiment, the buffer samples include measures of motor load current from the motor 104 and provided to the processor 120 of FIG. 1. Also in a preferred embodiment, the buffer samples are equal in number to the number of samples represented by the window size that was determined in step 404.

In addition, a root mean square value of motor load current of the motor is determined (step 408). In a preferred embodiment, the root mean square value of motor load current is calculated by the processor 120 of FIG. 1 using motor load current values obtained via the sensor 116 of FIG. 1 from the motor 104 of FIG. 1 as represented in the above-described buffer samples of step 406.

A verification is also made as to the state of the motor (step 410). In a preferred embodiment, this step 222 is conducted by the processor 120 with respect to the motor 104 of FIG. 1 for which an obstruction determination is desired, and specifically as to whether such motor 104 is in a steady state or a transient state.

If it is determined in step 410 that the motor is in a steady state, then statistical model matching is conducted with respect to steady state models using the state determination from step 410 and the root mean square motor load current calculation from step 408 (step 412). Specifically, in a preferred embodiment, the computed root mean square value of motor load current from step 408 is compared with corresponding values from the steady state training models of step 214 of the model fitting portion 202 of FIG. 2. Also in a preferred embodiment, such steady state training models are selected as most closely representing the motor load current of the motor. Also in a preferred embodiment, this step is conducted by the processor 120 of FIG. 1 using the steady state models 132 stored in the memory 122 of FIG. 1. In so doing, the processor 120 of FIG. 1 preferably compares the measure of motor load current with prior motor load current measures from such steady state models and selects one or more such models accordingly.

Next, an air circuit condition is estimate (step 414) using the selected steady state models. In certain preferred embodiments, the air circuit condition is estimated as a percentage obstruction 112 of the fluid flow passageway 107 of FIG. 1 and/or a distance 114 between the obstruction 110 and the fan 106 of FIG. 1. However, this may vary in other embodiments. For example, in one such preferred embodiment, one or more such measures of obstruction are estimated using a single selected steady state model, for example by using a value equal to a known obstruction value of such selected steady state model. In other preferred embodiments, one or more such measures of obstruction are estimated using multiple selected steady state models, for example by averaging, interpolating, and/or extrapolating between the obstruction values of such multiple selected steady state models.

In addition, in certain embodiments, the air circuit condition estimation determined from step 414 can be used in predictive trending (step 418) in order to generate health predictions 420 for the motor. For example, in certain embodiments, these results may be used to predict future values of the obstruction 110 of FIG. 1, and may thereby corresponding used in predicting any resulting effects of such future values on the health of the motor 104 and/or the air circuit 100 of FIG. 1. Also in a preferred embodiment, such predictive trending and health monitoring is conducted by the processor 120 of FIG. 1.

Conversely, if it is determined in step 410 that the motor is in a transient state, then a transient time value for the motor is calculated (step 422). In one embodiment, the transient time value comprises an amount of time for the motor to start up. In another embodiment, the transient time value comprises an amount of time for the motor to cool down. In yet another embodiment, the transient time value comprises an amount of time for the motor to attain a particular increase in motor load current, from an initial motor load current value to a subsequent motor load current value. Any number of other different values may be used for the transient time value. In a preferred embodiment, the transient time value is calculated by the processor 120 of FIG. 1 using motor load current values obtained via the sensor 116 of FIG. 1 from the motor 104 of FIG. 1.

In addition, statistical model matching is conducted with respect to transient state models using the state determination from step 410, the root mean square motor load current calculation from step 408, and the transient time value from step 422 (step 424). Specifically, in a preferred embodiment, the computed root mean square value of motor load current from step 408 and/or the transient time value calculated from step 422 are compared with corresponding values from the transient state training models of step 214 of the model fitting portion 202 of FIG. 2. Also in a preferred embodiment, such transient state training models are selected as most closely representing the motor load current and/or the transient time value of the motor. Also in a preferred embodiment, this step is conducted by the processor 120 of FIG. 1 using the transient state models 134 stored in the memory 122 of FIG. 1. In so doing, the processor 120 of FIG. 1 preferably compares the measure of motor load current and/or the transient time value with prior motor load current measures and/or transient time values from such transient state models and selects one or more such models accordingly.

Next, an air circuit condition is estimate (step 426) using the selected transient state models. In certain preferred embodiments, the air circuit condition is estimated as a percentage obstruction 112 of the fluid flow passageway 107 of FIG. 1 and/or a distance 114 between the obstruction 110 and the fan 106 of FIG. 1. However, this may vary in other embodiments. For example, in one such preferred embodiment, one or more such measures of obstruction are estimated using a single selected transient state model, for example by using a value equal to a known obstruction value of such selected transient state model. In other preferred embodiments, one or more such measures of obstruction are estimated using multiple selected transient state models, for example by averaging, interpolating, and/or extrapolating between the obstruction values of such multiple selected transient state models.

In addition, in certain embodiments, the air circuit condition estimation determined from step 426 can also be used in predictive trending as described above in connection with step 418 in order to generate the above-referenced health predictions 420 for the motor. For example, in certain embodiments, these results may be used to predict future values of the obstruction 110 of FIG. 1, and may thereby corresponding used in predicting any resulting effects of such future values on the health of the motor 104 and/or the air circuit 100 of FIG. 1 with respect to future transient conditions. Also in a preferred embodiment, such predictive trending and health monitoring is conducted by the processor 120 of FIG. 1.

It will be appreciated that the various steps of the process 200 and/or the model fitting portion 202 and/or condition detection portion 204 may differ from those depicted in FIGS. 2-4 and/or described herein. It will similarly be appreciated that certain of these steps may occur simultaneously and/or in a different order from that depicted in FIGS. 2-4 and/or described herein. For example, in various embodiments, steady state determinations (e.g., steps 208 and 222 of FIG. 2 and step 410 of FIG. 4) may occur before, after, or simultaneously with the root mean square motor load current calculations (steps 210 and 224 of FIG. 2 and step 408 of FIG. 4). Various other steps may also occur in a different order than, and/or may otherwise vary from, the presentation and order of the steps as depicted in FIGS. 2-4 above and described herein.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for determining an obstruction in an air circuit, the air circuit comprising a fan and a motor that drives the fan, for an environmental control unit, the method comprising the steps of:

obtaining a load current of the motor via a sensor;

determining a state of the motor via a processor;

generating a comparison via the processor by:

comparing the load current to a first plurality of values if the motor is in a steady state; and comparing the load current to a second plurality of values if the motor is in a transient state; and determining the obstruction using the load current and the comparison via the processor.

2. The method of claim 1, wherein:

each of the first plurality of values comprises a measure of load current of a corresponding one of a first plurality of models representing steady state operation of the motor;

each of the second plurality of values comprises a measure of load current of a corresponding one of a second plurality of models representing transient state operation of the motor; and the method further comprises the steps of:

selecting one of the models, based at least in part on the comparison of the load current to the plurality of values via the processor;

obtaining a measure of obstruction from the selected one of the models; and determining the obstruction using the measure of obstruction via the processor.

3. The method of claim 2, further comprising the steps of:

generating the first plurality of models using steady state motor data via the processor; and generating the second plurality of models using transient state motor data via the processor.

4. The method of claim 1, wherein the step of determining the obstruction comprises the step of:

determining a percentage obstruction of the air circuit using the load current and a predetermined value via the processor.

5. The method of claim 1, wherein the step of determining the obstruction comprises the step of:

determining a distance between the obstruction of the air circuit and the fan, using the load current and a predetermined value via the processor.

6. A system for determining an obstruction in an air circuit for an environmental control unit, the system comprising:

a sensor configured to at least facilitate obtaining a load current of a motor coupled to the air circuit; and a processor coupled to the sensor, the processor configured to at least facilitate:

determining a state of the motor;

generating a comparison by:

comparing the load current to a first plurality of values if the motor is in a steady state; and comparing the load current to a second plurality of values if the motor is in a transient state; and determining the obstruction using the load current and the comparison.

7. The system of claim 6, wherein:

each of the first plurality of values comprises a measure of load current of a corresponding one of a first plurality of models representing steady state operation of the motor;

each of the second plurality of values comprises a measure of load current of a corresponding one of a second plurality of models representing transient state operation of the motor; and the processor is further configured to at least facilitate:

selecting one of the models, based at least in part on the comparison of the load current to the plurality of values;

obtaining a measure of obstruction from the selected one of the models; and determining the obstruction using the measure of obstruction.

8. The system of claim 7, wherein the processor is further configured to at least facilitate:

generating the first plurality of models using steady state motor data; and generating the second plurality of models using transient state motor data.

9. The system of claim 6, wherein the processor is further configured to at least facilitate:

determining a percentage obstruction of the air circuit, a distance between the obstruction of the air circuit and the fan, or both, using the load current and a predetermined value.

10. The system of claim 6, wherein the processor is part of an environmental control system of an aircraft.

11. The system of claim 6, wherein the processor is part of a load protection and control unit (ELCU) of an aircraft.

12. The system of claim 6, wherein the processor is part of an integrated modular avionic unit (IMA) of an aircraft.

13. The system of claim 6, wherein the processor is part of a solid state power controller (SSPC) of an aircraft.

14. A system for determining an obstruction in an air circuit for an environmental control unit, the system comprising:

a sensor configured to at least facilitate obtaining a load current of a motor coupled to the air circuit; and a processor that is part of an aircraft and coupled to the sensor, the processor configured to at least facilitate:

comparing the load current to a predetermined value; and determining the obstruction using the load current and the predetermined value.

15. The system of claim 14, wherein the processor is further configured to at least facilitate:

comparing the load current to a plurality of values, each of the plurality of values comprising a measure of load current of a corresponding one of a plurality of models;

selecting one of the models, based at least in part on the comparison of the load current to the plurality of values;

obtaining a measure of obstruction from the selected one of the models; and determining the obstruction using the measure of obstruction.

16. The system of claim 15, wherein the processor is further configured to at least facilitate:

determining a state of the motor;

comparing the load current to a first plurality of values if the motor is in a steady state, each of the first plurality of values comprising a measure of load current of a corresponding one of a first plurality of models representing steady state operation of the motor; and comparing the load current to a second plurality of values if the motor is in a transient state, each of the second plurality of values comprising a measure of load current of a corresponding one of a second plurality of models representing transient state operation of the motor.

17. The system of claim 16, wherein the processor is further configured to at least facilitate:

generating the first plurality of models using steady state motor data; and generating the second plurality of models using transient state motor data.

18. The system of claim 14, wherein the processor is further configured to at least facilitate:

determining a percentage obstruction of the air circuit, a distance between the obstruction of the air circuit and the fan, or both, using the load current and the predetermined value.

19. The system of claim 14, wherein the processor is part of an environmental control system of the aircraft.

20. The system of claim 14, wherein the processor is part of a load protection and control unit (ELCU) of the aircraft.

* * * * *